US010134312B2

(12) United States Patent
Guinn et al.

(10) Patent No.: US 10,134,312 B2
(45) Date of Patent: Nov. 20, 2018

(54) INTERCHANGEABLE COVERS FOR STANCHIONS

(71) Applicant: Indian Industries, Inc., Evansville, IN (US)

(72) Inventors: Robert E. Guinn, Olney, IL (US); Larry Mitchell, Noble, IL (US)

(73) Assignee: Indian Industries, Inc., Evansville, IN (US)

( * ) Notice: Subject to any disclaimer, the term of this patent is extended or adjusted under 35 U.S.C. 154(b) by 0 days.

(21) Appl. No.: 15/350,481

(22) Filed: Nov. 14, 2016

(65) Prior Publication Data

US 2017/0140684 A1 May 18, 2017

Related U.S. Application Data

(60) Provisional application No. 62/256,846, filed on Nov. 18, 2015.

(51) Int. Cl.
*G09F 23/00* (2006.01)
*E04H 12/22* (2006.01)

(52) U.S. Cl.
CPC ..... *G09F 23/00* (2013.01); *E04H 12/2238* (2013.01); *E04H 12/2269* (2013.01)

(58) Field of Classification Search
CPC ..... G09F 23/00; G09F 19/22; E04H 12/2238; E04H 12/2269
USPC ..... 248/519, 346.01, 523, 511, 346.03
See application file for complete search history.

(56) References Cited

U.S. PATENT DOCUMENTS 2,748,516 A * 6/1956 McClusky ..... A47G 33/045 248/527
3,415,475 A * 12/1968 Goodman ..... F16M 11/22 248/158
5,207,238 A * 5/1993 Rivera ..... A45B 3/00 135/16
5,354,031 A * 10/1994 Bilotti ..... E04H 12/2238 248/511
5,497,965 A * 3/1996 Mathieu, Jr. ..... F16M 11/041 248/159
6,113,054 A * 9/2000 Ma ..... E04H 12/2238 248/158
6,349,500 B1 2/2002 Popham
D465,585 S 11/2002 Venegas, Jr.
D485,743 S 1/2004 Wilson, Sr.
6,986,496 B2 * 1/2006 Roberts ..... E04H 12/2246 248/519
7,215,300 B1 * 5/2007 Reid, Jr. ..... H01Q 1/42 343/872
D569,993 S 5/2008 Venegas, Jr.
7,388,558 B1 * 6/2008 Jacoletti ..... H01Q 1/42 343/872
7,614,600 B1 * 11/2009 Smith ..... G09F 23/00 135/16
D608,251 S * 1/2010 Dill ..... D12/114
7,797,880 B1 9/2010 Kamau
7,896,307 B2 * 3/2011 Berg ..... G09F 19/22 248/346.01

(Continued)

*Primary Examiner* — Kimberly T Wood
(74) *Attorney, Agent, or Firm* — Woodard, Emhardt, Moriarty, McNett & Henry, LLP; Charles Meyer

(57) ABSTRACT

Certain embodiments disclose a cover fitting over the base of a stanchion. Printed graphics may be included on the cover. The cover may be selectively removed and replaced with a different cover.

15 Claims, 8 Drawing Sheets

(56) References Cited

U.S. PATENT DOCUMENTS

| | | | | |
|---|---|---|---|---|
| 8,425,089 | B2 | 4/2013 | Venegas, Jr. | |
| 8,708,189 | B2 * | 4/2014 | Reitzig | B65D 90/00 220/256.1 |
| 9,080,751 | B2 * | 7/2015 | Steele | F21V 21/00 |
| 9,115,507 | B2 * | 8/2015 | Wyrostek | E04H 12/2292 |
| 9,296,527 | B2 * | 3/2016 | Schweinberg | B25H 3/02 |
| D790,082 | S * | 6/2017 | Guinn | D25/133 |
| 2003/0164630 | A1 * | 9/2003 | McKinney | B60N 2/48 297/220 |
| 2005/0012085 | A1 * | 1/2005 | Lavi | E01F 13/026 256/65.14 |
| 2006/0125263 | A1 * | 6/2006 | Elwell | B60R 13/00 296/1.08 |
| 2006/0290068 | A1 * | 12/2006 | Berdichevsky | F16J 15/3228 277/549 |
| 2007/0209101 | A1 * | 9/2007 | Gensch | E03D 3/00 4/300 |
| 2008/0263920 | A1 * | 10/2008 | Trigg | G09F 3/00 40/299.01 |
| 2009/0178316 | A1 | 7/2009 | Parenti et al. | |
| 2012/0005928 | A1 * | 1/2012 | Ella | A47C 31/113 40/320 |
| 2013/0153590 | A1 * | 6/2013 | Reitzig | B65D 90/00 220/730 |
| 2013/0163236 | A1 * | 6/2013 | Steele | F21V 21/00 362/190 |
| 2015/0128330 | A1 * | 5/2015 | Mumme | A42B 3/003 2/244 |
| 2015/0327614 | A1 * | 11/2015 | Garden, Sr. | A42B 1/004 2/209.12 |

* cited by examiner

INTERCHANGEABLE COVERS FOR STANCHIONS

CROSS REFERENCE TO RELATED APPLICATIONS

The present application claims priority to U.S. Provisional Patent Application No. 62/256,846, filed on Nov. 18, 2015, which is incorporated herein by reference.

FIELD OF THE INVENTION

The present disclosure deals with covers for stanchions.

BACKGROUND

Temporary barrier systems have many useful applications ranging from defining queue lines, to preventing access to certain areas, to general crowd control. Many available barrier devices include a post and a long rope, chain, or some other type of line that connects to an adjacent barrier device or exterior anchor. These barrier devices are often used at events that are attended by a large amount of people and are generally positioned in places where they are in clear view. Therefore, it would be useful to have a device that allows messages or decoration to be presented on these barrier devices.

SUMMARY

Certain embodiments include a cover for a base of a stanchion. Graphics representing business or sports logos, decorative designs, advertisements, informational messages, or any other desired indicia may be printed onto the cover. The stanchion may include a base and a pole extending upward from the base. The cover defines an opening that has a perimeter and a diameter that allows the pole to extend through the cover. The perimeter of the opening defined in the cover is continuous. In some embodiments, the cover is sized to fully cover the entirety of the base. In other embodiments, the cover is sized to sit on top of the base but not fully cover the base. When desired, the cover may be removed from the stanchion, and a new cover with different graphics may be used to cover the base.

In some embodiments, the cover is placed on the base before the pole is mounted to the base. The connection of the pole to the base may assist in securing the cover to the base. In certain alternate embodiments, the diameter of the opening in the cover is substantially equal to or greater than the diameter of the pole of the stanchion and allows the cover to be slid upward or downward along the pole after the pole is mounted to the base, allowing the cover to be installed or removed from the assembled stanchion.

In some embodiments, the graphics are directly printed on a flat substrate which is then molded into a shape that fits over a base of a stanchion. Certain alternate embodiments include a graphic film. Graphics can be printed onto the graphic film. The graphic film may be attached to a substrate using an adhesive, heat bond, fusion, or any other desired method. In some embodiments the substrate is made from a thermoplastic material, and the molding may be completed using a vacuum forming process.

DESCRIPTION OF PREFERRED EMBODIMENTS

Figure 1:
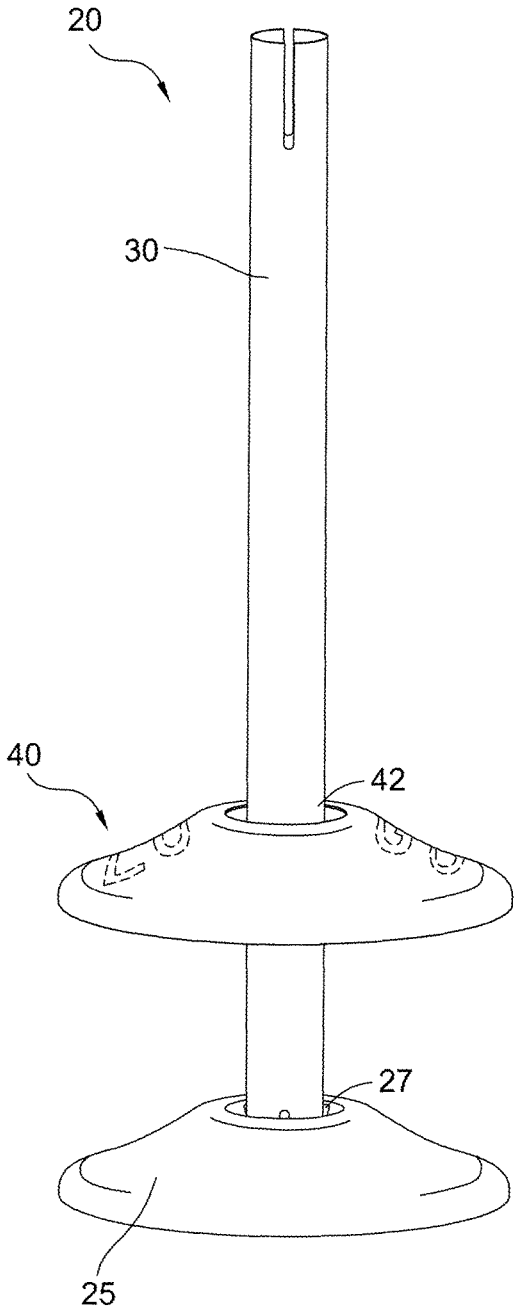
FIG. 1 is a perspective view of a stanchion with one embodiment of a cover for the base located along the pole of the stanchion.

For the purposes of promoting an understanding of the principles of the disclosure, reference will now be made to the embodiments illustrated in the drawings and specific language will be used to describe the same. It will nevertheless be understood that no limitation of the scope of the disclosure is thereby intended, such alterations and further modifications in the illustrated device, and such further applications of the principles of the disclosure as illustrated therein being contemplated as would normally occur to one skilled in the art to which the disclosure relates.

The present disclosure pertains generally to the field of stanchions and particularly to decorative covers for stanchions. Stanchions generally include a base with an upwardly extending pole. A chain, belt, or a similar divider extends from the pole to an adjacent pole or anchor and may be used for a variety of purposes. For example, stanchions may be used for temporary or semi-permanent crowd control such as defining lines or lanes, or a stanchion may be used to display signs. An example stanchion is disclosed in pending application Ser. No. 14/926,028 filed on Oct. 29, 2015, incorporated herein by reference. Aspects of the present disclosure include interchangeable covers which may be removably mounted over the base of a stanchion. In some embodiments, graphics such as logos, advertisements, or other indicia may be printed on the covers.

In certain aspects, the covers have a substantially circular cross-section with a hole in the middle through which the pole of a stanchion may extend. The covers are three-dimensionally shaped and profiled to mate with and cover a portion of or the entirety of the base of the stanchion. Optionally, the cover may extend around the edges of the base portion so that the cover edges are adjacent the support surfaces of the stanchion and the underlying stanchion base is completely concealed.

The substrate may be made from a moldable thermoplastic material. In one representative method the desired graphics for a cover are digitally printed directly on the substrate material and then molded into the desired shape. In a variation, the graphics can be reverse printed on the bottom side of a clear/transparent substrate, so that the graphics are visible yet protected on the inside of the molded cover. In an alternate method of preparation, the desired graphics for a cover are digitally printed on a graphic film type of material. The graphic film material is then applied to a substrate and the combination is molded, for example using a vacuum forming process, into a shape that is configured to fit over the base of a stanchion. The graphic film provides a suitable material for printing, and can be printed and applied so it does not unduly stretch or distort the content during the forming process.

The term continuous as used in this description to describe the perimeter of an opening in a cover means that the perimeter permanently stays continuous. To be considered continuous, the only method to make the perimeter of the opening discontinuous is to break the cover so that the perimeter of the opening may not be made continuous again. For example, a cover that includes a removable adhesive, Velcro, or another type of attachment mechanism that allows two edges of the cover to be disconnected and then connected is not considered to be continuous.

The term graphics as used in this description refers to any type or combination of a logo, design, advertisement, informational message, artwork or any other form of visual indicia printed on a surface. For example, graphics may include one or more of text, a picture, a design, a color or any combination of these elements or additional visual elements. Printed means the graphics are affixed using one or more inks, toner, paint, or a comparable method of marking.

FIG. 1 illustrates an example of a stanchion 20 that includes an interchangeable cover 40. Stanchion 20 includes a base 25 and a pole 30 that extends upward from base 25. Base 25 includes an opening 27 which may receive pole 30. In some embodiments, pole 30 may be removable from the opening in base 25. A sign or a linkage member (not shown), such as a chain, belt, ribbon, rope, or any other suitable type of line that may be used to form a barrier, may extend from pole 30.

Figure 2:
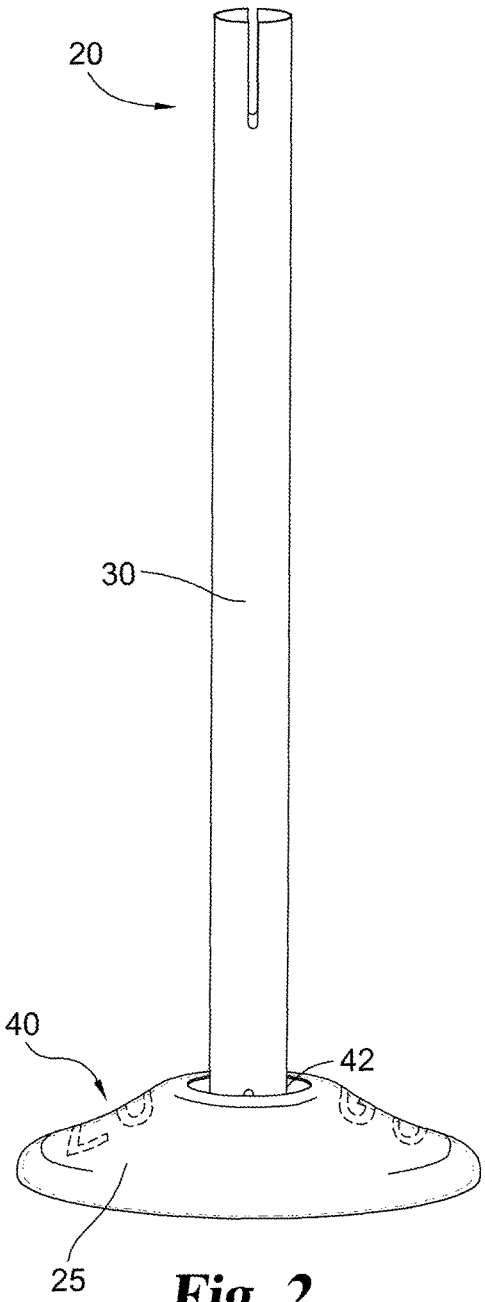
FIG. 2 is a perspective view of the stanchion and cover of FIG. 1 with the cover fitted over the base of the stanchion.

In the embodiment illustrated in FIG. 1, base and 25 and pole 30 are previously assembled. Cover 40 has an opening 42 with a diameter at least equal to and/or slightly larger than the diameter of pole 30. The diameter of opening 42 allows cover 40 to slide along pole 30. As shown in FIG. 2, cover 40 may be installed by moving the cover downward along pole 30 so that it covers base 25. When desired, cover 40 may be removed by sliding cover 40 upward until it clears the top of pole 30. After being removed, cover 40 may be replaced with a cover that has a different graphic. Also, cover 40 may be removed from one stanchion and moved to be used on a different stanchion.

Figure 3:
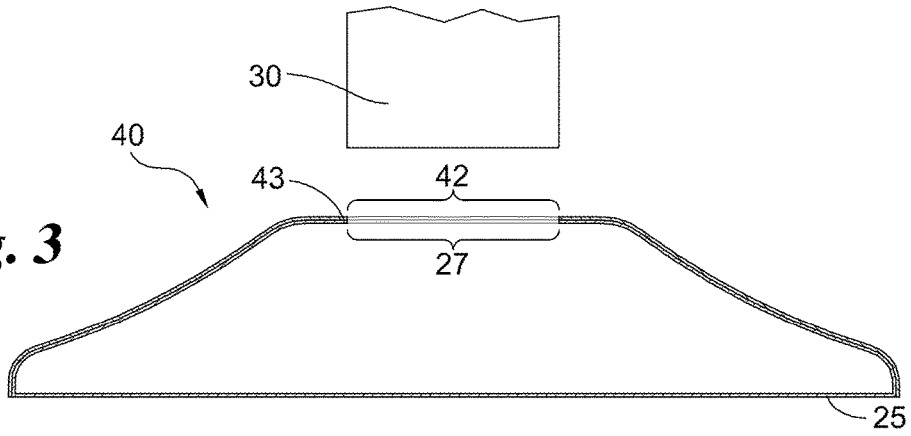
FIG. 3 is a cross-sectional view of a stanchion base with a cover embodiment with a pole.
Figure 4A:
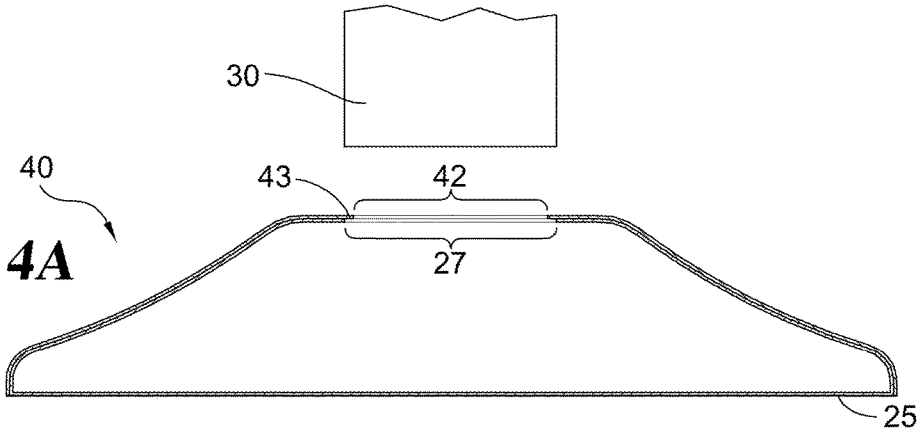
FIG. 4A is a cross-sectional view of a stanchion base with an alternate cover embodiment with a pole prior to insertion of the pole into the base.
Figure 4B:
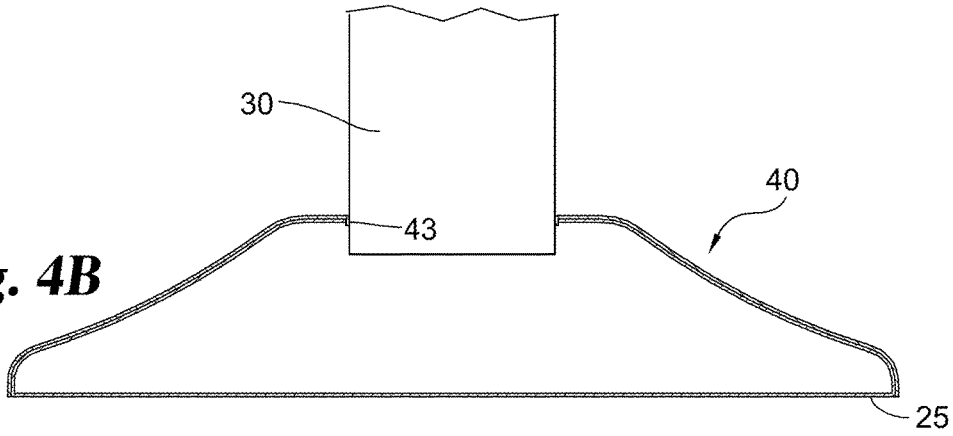
FIG. 4B is a view of the embodiment of FIG. 4A with the pole inserted into the base.
Figure 5:
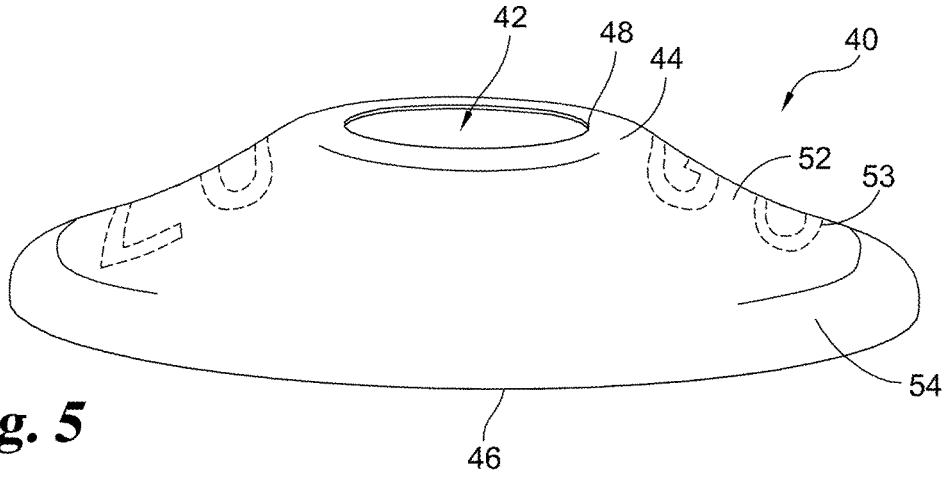
FIG. 5 is a perspective view of the cover of FIG. 1.
Figure 6:
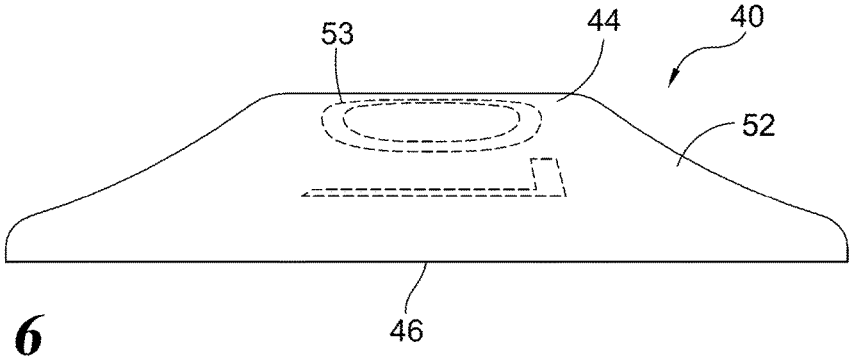
FIG. 6 is a left side view of the cover of FIG. 1.
Figure 7:
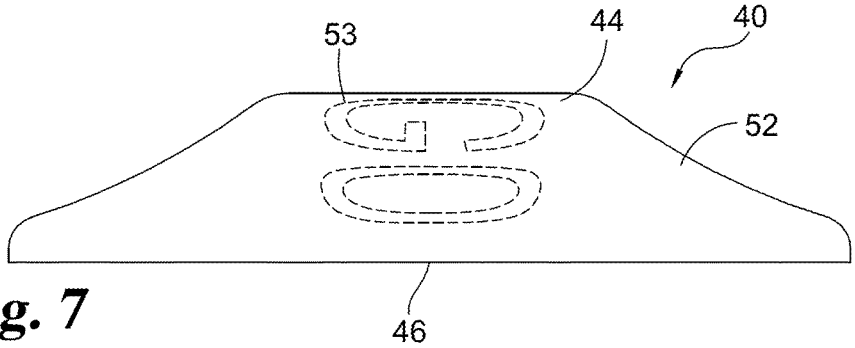
FIG. 7 is a right side view of the cover of FIG. 1.
Figure 8:
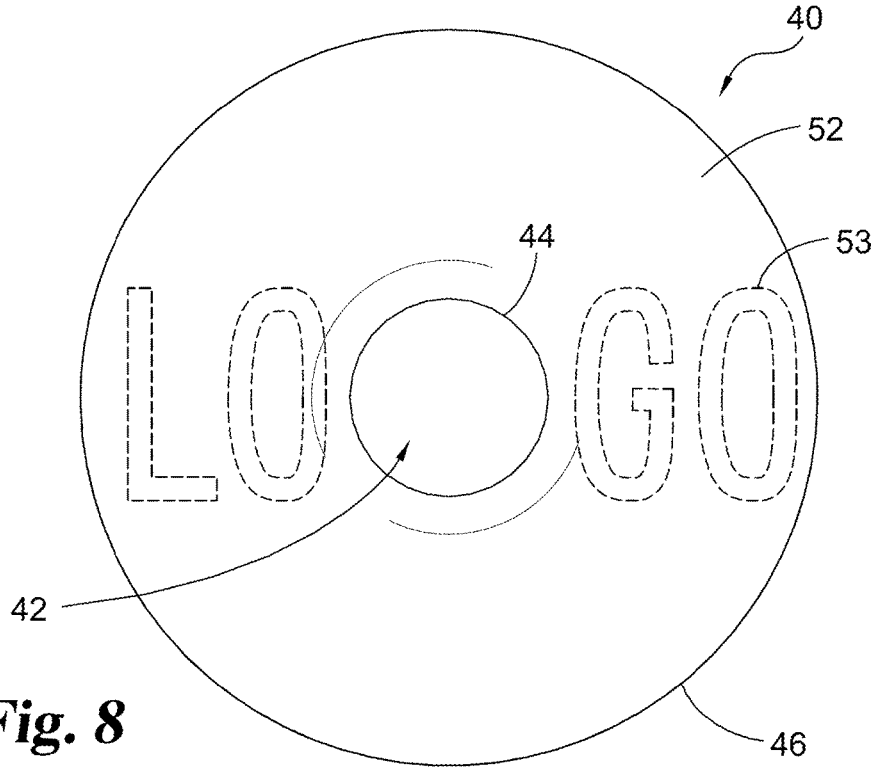
FIG. 8 is a top view of the cover of FIG. 1.
Figure 9:
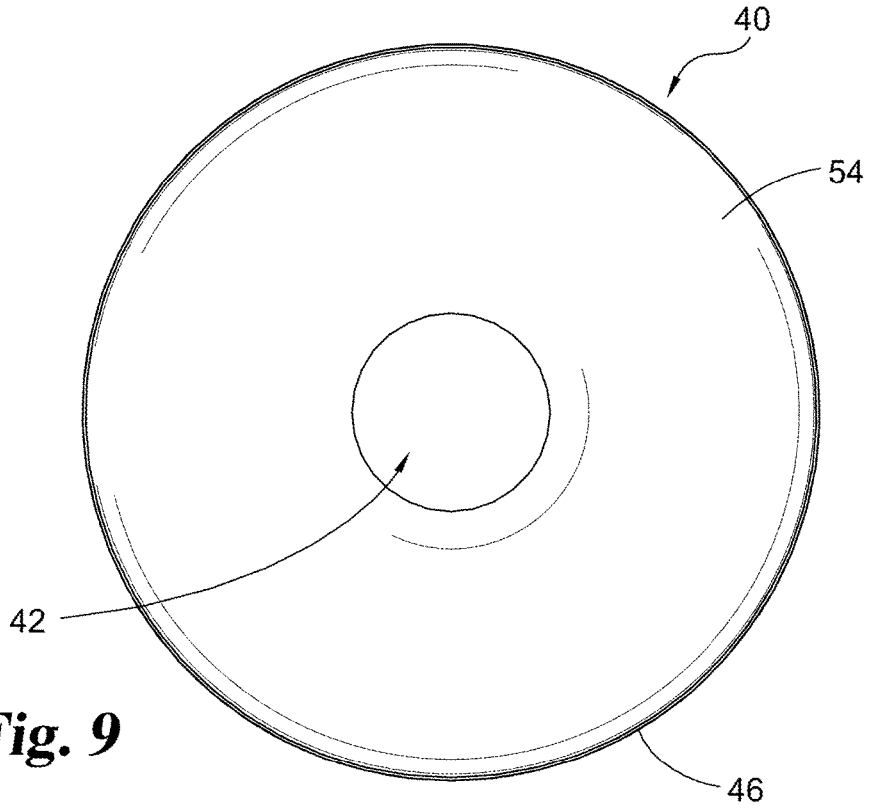
FIG. 9 is a bottom view of the cover of FIG. 1.

Certain arrangements of cover 40 and base 25 are illustrated in FIGS. 3, 4A and 4*b*. In FIG. 3 cover opening 42 has a diameter equal to or greater than the diameter of pole 30, and generally matches the diameter of base opening 27. In the arrangement illustrated in FIG. 3, cover 40 can be slid along pole 30 as illustrated in FIG. 1, or alternately cover 40 can be placed on base 25 prior to the insertion of pole 30 into the socket of base 25.

In FIGS. 4A and 4B, the diameter of cover opening 42 is slightly smaller than the diameter of pole 30 and the socket or base opening 27, yet allows pole 30 to extend through the cover. During assembly, cover 40 is placed over base 25 while pole 30 is removed from base 25. A slight lip or flange 43 of cover 40 extends inward over opening 27 beyond the edge of opening 27. Lip 43 may extend circumferentially around all or only selected portions of opening 27 as desired. Lip 43 may be flexible or bendable. With cover 30 in place, pole 30 may be inserted and pressed into opening 27 and mounted to base 25 in its normal method of assembly. As pole 30 is inserted into the base, the pole diameter impinges on and causes lip 43 to slightly fold, curl or bend downward so that it is caught and pinched between pole 30 and base 25, optionally forming a friction fit. Alternatively, lip 43 may be preformed in a bend that extends downward into the socket of the base before the pole 30 is inserted into the socket. With lip 43 captured, cover 40 is locked in place in a manner which prevents and/or minimizes movement of the cover on the stanchion. Additionally, the friction fit may provide stability to hold pole 30 within the base socket and to prevent lean. When desired, pole 30 may be removed from base 25, allowing cover 40 to be removed and/or replaced.

Views of cover 40 in further detail are shown in FIGS. 5-9. Cover 40 is sized and shaped so that it may fit on top of or over base 25 of stanchion 20. In the example shown, cover 40 has a conical shape with a substantially circular cross-section. The interior of cover 40 is hollow. Cover 40 defines an opening 42 and pole path extending entirely through cover 40 from a top edge 44 of cover 40 to open bottom edge 46. Top edge 44 and bottom edge 46 may form a continuous perimeter 48 around opening 42. In some embodiments, cover 40 is molded as a solid piece so that perimeter 48 is continuous and cannot be made discontinuous without damaging cover 40. When top edge 44 and bottom edge 46 have a continuous perimeter, pole 30 of stanchion 20 must extend through opening 42 when cover 40 is positioned to cover base 25.

In the example shown, cover 40 has a circular, slightly conical shape. In other embodiments, the shape of cover 40 may be varied. For example, cover 40 may be rectangular or triangular and sized to cover the conical base 25 shown in FIG. 1. Alternatively, cover 40 may be any shape that allows cover 40 to cover or sit on top of base 25. In some embodiments, cover 40 may have an inner profile and/or an outer profile or shape that matches the profile of base 25, but in other embodiments, cover 40 may have a different shape than the shape of base 25. Cover 40 may be made from a durable material that allows cover 40 to be used over a period of time and that allows cover 40 to be removed from a stanchion 20 and reused on a different stanchion. Cover 40 may be made from a rigid material or made from a more flexible, resilient material.

In some embodiments, cover 40 is made from a sheet of plastic or thermoplastic material such as polystyrene, ABS, acrylic, polycarbonate, polyethylene, polypropylene, polyethylene terephthalate glycol (PETG) or polyvinyl chloride (PVC) material. The material is initially provided as a sheet and cut to a desired shape and size as a blank in a flat configuration and graphics may be added. The blank is then molded into the desired shape, for example using a vacuum forming process. In other embodiments, the cover may be molded, shaped and/or formed using any other process that would be known to one of ordinary skill in the art.

In certain embodiments, cover 40 includes a graphic film 52 and a substrate 54. In the embodiment shown, graphic film 52 is adhered to the top surface 44 of substrate 54. In other embodiments, graphic film 52 may only cover a portion of the top surface 44 of substrate 54 or may be adhered to other surfaces of substrate 54.

Graphics 53 such as advertisements, text, company or team logos, decorative patterns, or any other desired indicia may be printed on graphic film 52. In some embodiments, graphic film 52 may be made from vinyl; however, in other embodiments graphic film 52 may be made from any other material which may be printed and molded.

Substrate 54 may be made from any material that allows attachment to graphic film 52. In some embodiments, substrate 54 may be made from a thermoplastic or another suitable material. It may be desired to form substrate 54 from a plastic or another similarly durable material that allows cover 40 to be reused or kept on stanchion 20 for a long period of time. In other embodiments, substrate 54 may be made from a less durable material such as cardboard or cardstock to form a cover 40 that is more suited for temporary use.

Graphic film 52 may be applied to substrate 54 to form cover 40 using a variety of methods. In some embodiments, graphic film 52 may be applied to substrate 54 using an adhesive. For example, graphic film 52 may have an adhesive backing that is covered while graphics are printed on film 42. The covering may be removed to expose the adhesive and so that graphic film 52 can be adhered to substrate 54. In other embodiments, alternative attachment methods may be used to secure graphic film 52 to substrate 54. For example, graphic film 52 may be attached to substrate 54 using a spray adhesive or any other form of separate adhesive, a heat bond by melting, using fusion, or by any other suitable method.

Figure 10:
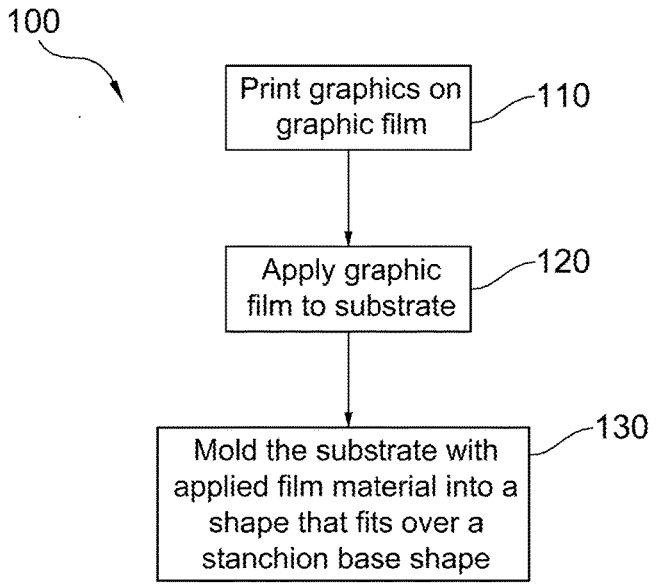
FIG. 10 is a flow chart for a process for manufacturing a cover.

FIG. 10 is a flow chart 100 of a process for manufacturing certain embodiments of a cover. First, graphics are printed 110 on a graphic film material 52. The graphics may be a company or sports team logo, an advertisement, a decorative pattern, or any other kind of indicia that is desired. In some embodiments, the film material is a vinyl film, but in other embodiments, the film material may be any material on which graphics may be printed. The graphics may be printed on the top surface of the film material, or the graphics may be reverse printed on the back of a clear film to protect the ink from fading or scuffing. In other embodiments, a durable coating may be applied over the graphics to prevent removal or damage to the graphics.

Figure 11:
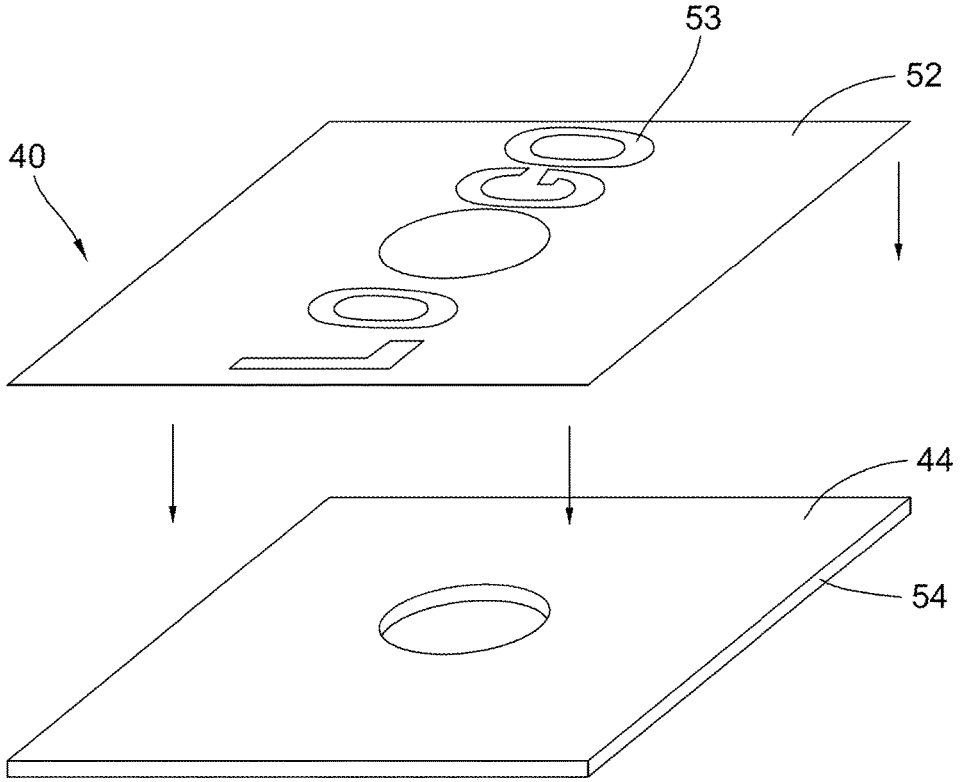
FIG. 11 is a perspective view of the parts of a cover before the cover is molded.

After printing on the graphic film 52, the graphic film is applied 120 to a substrate 54 (see FIG. 11). The graphic film 52 may be applied to upper surface 44 using an adhesive, heat bond by melting, fusion, or using any other method to attach the film material to the substrate.

The combined graphic film and substrate assembly is then molded 130 into a shape that mates with the base of the stanchion which is to be covered to form a cover 40. In some embodiments, this molded shape may allow the cover to substantially cover and rest on top of the base of the stanchion. In other embodiments, the cover may be molded to entirely cover the base of the stanchion. The molded shape may be the same shape as the base of the stanchion, or may be a different shape than the base of the stanchion.

As shown in FIG. 11, in some embodiments, the graphic film 52 may be attached to the substrate 54 before cover 40 is cut and molded to form a shape that fits over a base of a stanchion. Although not required, in some embodiments, graphic film 52 may be distortion printed to account for stretching during the molding process.

In certain embodiments, graphics 53 are directly printed on a cover substrate 44 without using a film. A cover with graphics 53 printed directly on the substrate may look the same as illustrated in FIGS. 5-9. For example, the graphics may be printed on a flat pre-molded substrate using an ink that will stretch and will not crack during the mold process. The printed substrate is then molded into the desired cover shape. In a variation, the graphics can be reverse printed on the bottom side of a clear and/or transparent substrate. Once the cover is molded, the graphics are visible through the cover yet the ink is protected on the inside of the cover.

Figure 12:
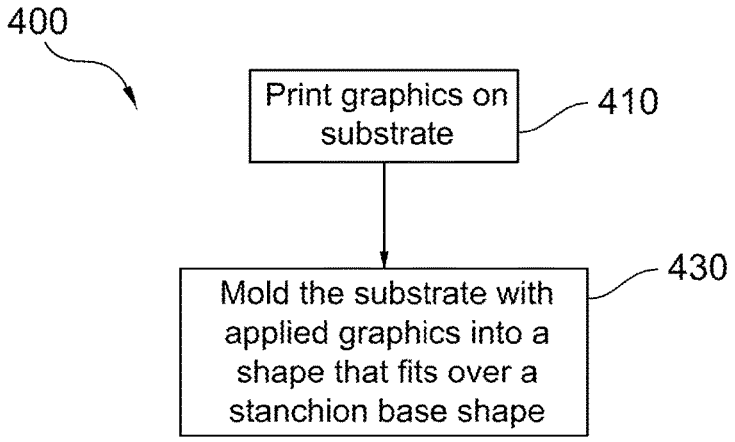
FIG. 12 is a flow chart for an alternate process for manufacturing a cover.
Figure 13:
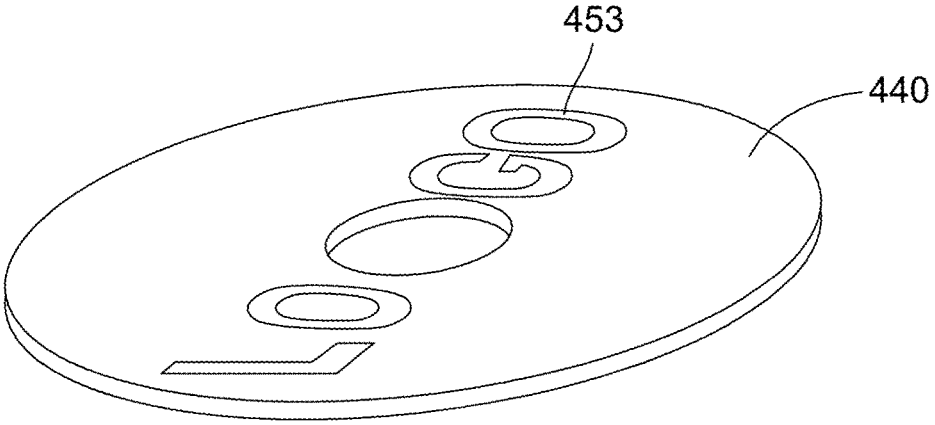
FIG. 13 is a perspective view of the cover before the cover is molded.

FIG. 12 is a flow chart 400 of a process for manufacturing certain embodiments of a cover. First, graphics 453 are printed 410 on a substrate material 440, as illustrated in FIG. 13. The graphics may be a company or sports team logo, an advertisement, a decorative pattern, or any other kind of indicia that is desired. The graphics 453 may be printed on the top surface of the substrate 440, or the graphics may be reverse printed on the back of a clear substrate to protect the ink from fading or scuffing. Optionally an ink may be used which is stretchable during molding without cracking. In some embodiments, a durable coating may be applied over the printed graphics to prevent removal or damage to the graphics.

The substrate 440 is then molded 430 into a shape that mates with the base of the stanchion which is to be covered to form a cover. In some embodiments, this molded shape may allow the cover to substantially cover and rest on top of the base of the stanchion. In other embodiments, the cover may be molded to entirely cover the base of the stanchion. The molded shape may be the same shape as the base of the stanchion, or may be a different shape than the base of the stanchion.

Figure 14:
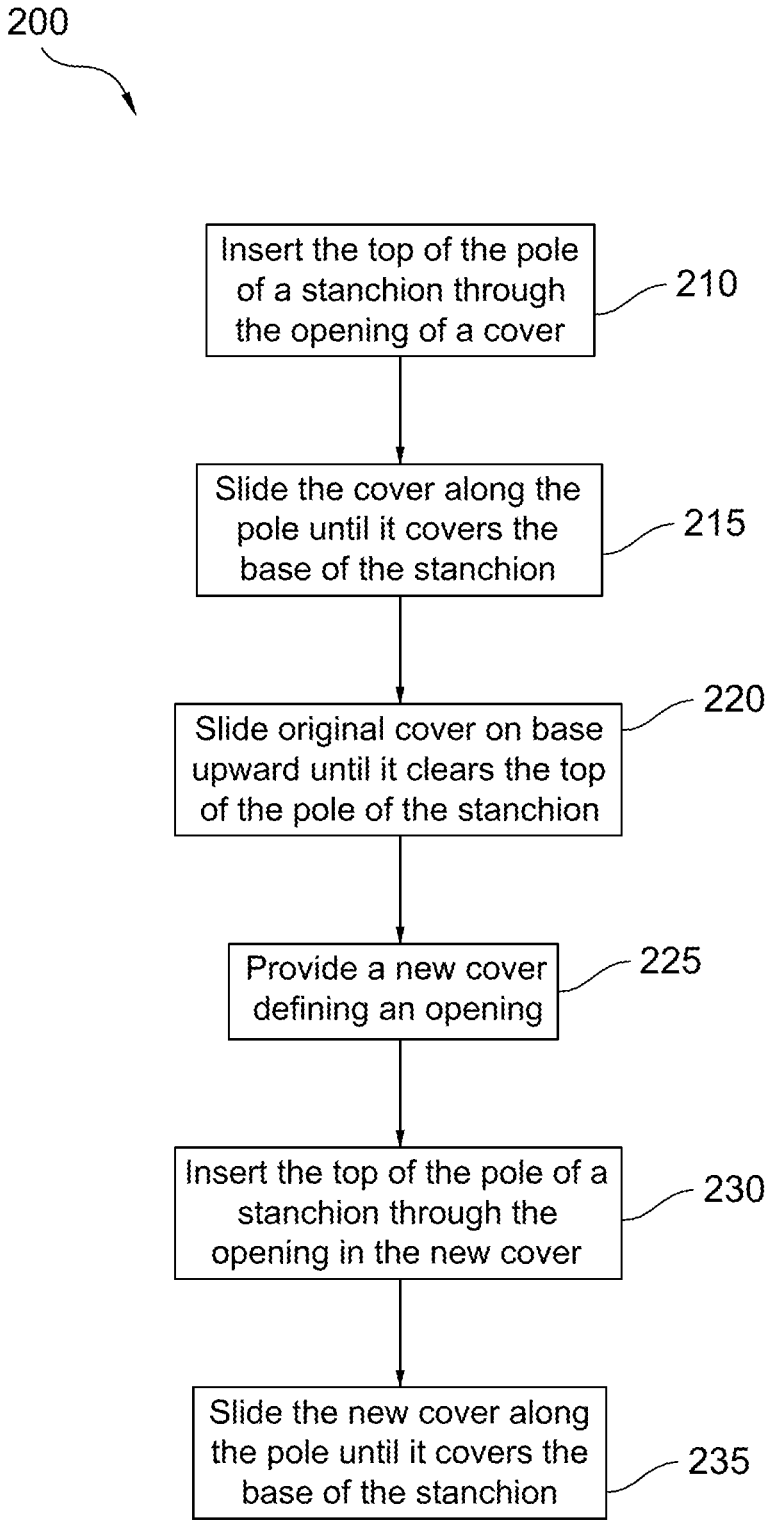
FIG. 14 is a flow chart for a method of installing and interchanging covers onto a stanchion to cover the base of the stanchion.

FIG. 14 is a flow chart 200 for one method of installing and interchanging covers onto a stanchion to cover the base of the stanchion. To install a cover on the stanchion according to certain embodiments, the top of the pole of the stanchion is inserted 210 through the opening of the cover. The cover is then slid 215 downward along the pole until it partially covers or fully covers the base of the stanchion.

To interchange the original cover with a new cover, the original cover is removed by sliding 220 the original cover upward along the pole until it clears the top of the pole. The original cover may be saved for use in the future on the same stanchion or may be installed on other stanchions. After removing the original cover, a new cover defining an opening is provided 225. The new cover can be any shape or size that allows the cover to fit over the base of the stanchion. Graphics such as an advertisement, company logo, or decorative design may be included on the cover.

The top of the pole of the stanchion is inserted 230 through the opening defined through the new cover. The opening in the cover is sized to allow the cover to freely slide along the pole of the stanchion. The cover is then slid 235 downward along the pole toward the base of the stanchion until the cover is positioned so that it substantially covers the base or surrounds and conceals the base.

Figure 15:
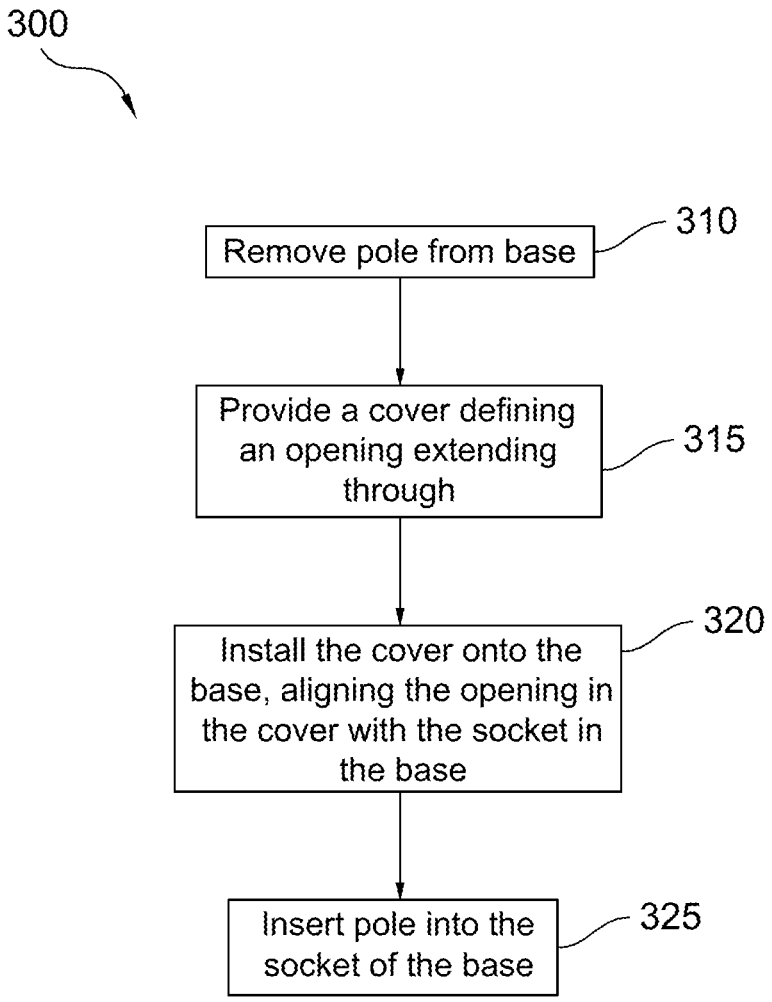
FIG. 15 is a flow chart for a method of installing a cover onto a stanchion to cover the base of the stanchion.

FIG. 15 is a flow chart 300 of an alternate method of installing a cover onto a stanchion to cover the base of the stanchion. To install a cover on the stanchion, the pole is removed from the base 310. If there is already a cover on the base of the stanchion, the old cover may be removed once the pole is removed from the base. Next, a cover defining an opening is provided 315. The new cover is placed onto the base and aligned 320 so that the opening in the cover is aligned with the opening in the base. In some embodiments, the cover may include a lip that surrounds the opening or which extends partially over or into a portion of the socket of the base when the cover is position on the base.

The pole is then inserted into the opening in the base 325. If present, the lip of the cover is optimally bent or curled into the opening. The lip portion is pinched between the base and the pole of the stanchion to help prevent the cover from shifting or moving relative to the base of the stanchion. This process may be reversed to remove the cover or repeated to interchange an old cover with a new cover on the base of the stanchion.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

The invention claimed is:

1. A stanchion assembly comprising:

a base wherein said base has a bottom, a top surface spaced above the bottom and an outward facing circular conical sidewall surface extending from the bottom to the top surface, said top surface defining a pole opening;

a pole with a pole diameter, wherein said pole is mountable in said pole opening to extend upward from said base;

a cover with a circular conical shape molded from a sheet of rigid thermoplastic material wherein said cover is adapted to be removably placed over said base, and wherein said cover is sized and shaped to extend at least partially over said top surface and said sidewall surface, wherein said cover defines an opening with a continuous perimeter and with a diameter greater than the pole diameter and sized so that said pole can slidably move through the cover;

wherein the diameter of said cover opening is less than the diameter of said pole opening so that a lip portion of said sheet of thermoplastic material extends from above said top surface downward into said pole opening when said cover is placed over said base;

wherein said lip portion is clamped between said pole and locks said cover to said base when said pole is mounted in said pole opening; and, wherein said cover displays printed graphics.

2. The stanchion assembly of claim 1, wherein said lip portion is preformed with a bend to extend into said pole opening when said cover is placed over said base.

3. The stanchion assembly of claim 1, wherein said printed graphics are directly printed on said thermoplastic material.

4. The stanchion assembly of claim 3, wherein said graphics are directly printed on said thermoplastic material in a flat configuration.

5. The stanchion assembly of claim 4, wherein said thermoplastic material is transparent and said graphics are reverse printed on a lower surface of said material so that the graphics are visible through the material.

6. The stanchion assembly of claim 1, wherein said graphics are printed on a film and said film is adhered to said molded thermoplastic material.

7. The stanchion assembly of claim 1, wherein an interior profile of said cover is molded to mate with the outward profile of said circular conical sidewall.

8. The stanchion assembly of claim 1, wherein an outer profile of said cover is molded to match the outward profile of said base.

9. The stanchion assembly of claim 1, wherein the diameter of said cover opening is equal to or greater than the diameter of said pole.

10. A cover for a stanchion assembly having a base with a top surface and a circular sidewall surface and a pole with a diameter extending upward from said base, the cover comprising:

a substrate formed from a thermoplastic material molded in a rigid circular conical shape adapted to be removably placed over the base wherein the circular conical shape is sized and shaped to cover the entirety of the top surface and the circular sidewall surface of the base;

wherein said substrate defines a cover opening with a continuous perimeter and defining a diameter sized greater than the pole diameter so that the pole can slide through the opening;

wherein a lip portion of said substrate extends from above the base top surface downward into a pole opening in the base and is clamped between the pole and the base to lock said cover to the base when the pole is in the pole opening ;and, wherein said cover displays printed graphics.

11. The cover for a stanchion assembly of claim 10, wherein said cover displays graphics directly printed on said thermoplastic material.

12. The cover for a stanchion assembly of claim 11, wherein said graphics are directly printed on said thermoplastic material in a flat configuration.

13. The cover for a stanchion assembly of claim 11, wherein said thermoplastic material is transparent and said graphics are reverse printed on a lower surface of said material.

14. The cover for a stanchion assembly of claim 10, wherein said graphics are printed on a film adhered to said thermoplastic material.

15. The stanchion assembly of claim 1, wherein the pole has a lower end, wherein the lower end of the pole is received within said pole opening and wherein said pole extends upward from said base.

* * * * *